United States Patent [19]

Parrish, Jr.

[11] 4,153,205

[45] May 8, 1979

[54] SHORT SEAT FUEL INJECTION NOZZLE VALVE

[75] Inventor: Walter A. Parrish, Jr., Hazel Crest, Ill.

[73] Assignee: Allis-Chalmers Corporation, Milwaukee, Wis.

[21] Appl. No.: 843,450

[22] Filed: Oct. 19, 1977

[51] Int. Cl.[2] ..... F02M 61/04; B05B 1/30

[52] U.S. Cl. ..... 239/533.9; 239/533.12

[58] Field of Search ..... 239/533.3–533.12

[56] References Cited

U.S. PATENT DOCUMENTS

| | | | |
|---|---|---|---|
| 2,927,737 | 3/1960 | Zeuch et al. | 239/533.3 |
| 3,836,080 | 9/1974 | Butterfield et al. | 239/533.4 X |
| 3,980,237 | 9/1976 | Parrish, Jr. | 239/533.3 |

*Primary Examiner*—Robert W. Saifer

*Attorney, Agent, or Firm*—Arthur L. Nelson

[57] ABSTRACT

A differential valve in a fuel injection nozzle having double conical surfaces with a smaller included angle between the valve and the valve seat of the valve body below the valve seat seal than the included angle between the valve and valve seat of the valve body above the valve seat seal so the effective seat seal of the valve will migrate downstream. An annular groove is provided on the downstream conical surface below the seat seal to limit the migration of the effective seat seal of the differential valve during use.

10 Claims, 3 Drawing Figures

PRIOR ART

SHORT SEAT FUEL INJECTION NOZZLE VALVE

This invention relates to a fuel injection nozzle and more particularly to a double conical surface differential valve with the smaller included angle between the valve and valve seat of the valve body below the valve seat seal to cause the effective valve seat seal to migrate downstream. The valve includes an annular groove formed on the downstream conical surface to limit the migration of the effective valve seat seal and also limit the change in differential area exposed to the pressure of the incoming fluid from the fuel injection pump. This in turn limits the change in valve opening pressure throughout the service life of the valve assembly.

A differential valve in a fuel injection nozzle is normally biased to a closed position by a spring and is opened in response to the fluid pressure on the area of the differential valve exposed to the incoming pressure of fluid from the pump. The pressurized fluid lifts the valve against the force of the spring when the pressure in the fuel injection nozzle reaches a predetermined value. As the valve seat wears with use, the spring length increases slightly and the spring force is reduced with a consequent lowering of valve opening pressure.

A differential valve having double conical surfaces on the valve body or on the valve needle defines a line of contact forming the seat seal on the mating element of the valve as the valve closes. If the included angle between the valve and the valve body is smaller downstream from the valve seat seal than the included angle upstream from the valve seat seal, the effective seat seal will migrate downstream with wear of the valve. With a downstream migration of the valve seat seal, it will cause more area above the valve seat seal line to be exposed to the pressure of the incoming fluid from the pump. Since the area exposed to pump pressure is increased and if the spring load remains essentially constant, the valve opening pressure would decrease. If the opening or the closing pressure of the valve is reduced too much, combustion gases can more easily enter the nozzle and cause rapid damage and increased carbon buildup on the valve and in the nozzle. Accordingly, it is desirable to limit the area of the differential valve exposed to the incoming fuel injection pump pressure and thereby limit the predetermined minimum opening pressure of opening the differential valve. Accordingly, the provision of a groove on the differential valve downstream from the valve seat seal limits the downstream migration of the effective seat seal and maintains the opening pressure for the differential valve above a predetermined value.

Accordingly, this invention provides a double conical surface differential valve in which the line adjoining the conical surfaces forms the initial seat seal with the mating valve body. The conical surfaces may be formed on either the valve or the valve body although a single cone surface is preferred on the valve seat formed by the valve body and the double conical surfaces on the valve.

It is an object of this invention to provide a differential valve in a nozzle assembly having a double conical valve for seating on a single cone surface valve body with an annular groove in the cone surface of the valve downstream from the valve seat seal to limit the migration of the effective valve seat seal during normal operation of the valve, and thereby limit the area of the differential valve exposed to the incoming pressure from the fuel injection pump as well as the minimum opening pressure of the differential valve.

It is another object of this invention to provide a nozzle assembly having a double conical surface on the valve body for engaging a single cone surface on the valve for maintaining a predetermined effective valve seat seal diameter by the use of an annular recess on the valve body downstream from the valve seat seal of the differential valve.

It is a further object of this invention to provide a double cone differential valve with a larger differential angle between the valve and the valve body above the valve seat seal than the differential angle between the valve and the valve body below the valve seat seal to assure migration of the effective seat seal downstream and an annular groove on the lower cone of the differential valve to limit the migration of the effective valve seat seal and thereby limit the minimum opening pressure of the differential valve.

It is a further object of this invention to provide a double cone differential valve with a larger included angle between the surface of the valve body and the surface of the valve upstream from the valve seat seal than the included angle between the valve body and the surface of the valve downstream from the valve seat seal to cause the effective seat seal of the valve to move downwardly instead of upwardly due to wear between the valve and valve body. An annular groove is positioned immediately below the valve seat seal to limit the downstream migration of the effective valve seat seal due to wear and maintain an opening and closing pressure of the differential valve at or above the predetermined value.

The objects of this invention are accomplished by providing a nozzle assembly having a double conical surface on one of the elements of the nozzle assembly consisting of the valve and the valve body, and a single cone surface on the other of the elements. The peripheral line adjoining the differential conical surfaces defines the seat seal of the valve. The included angle between the upper conical surfaces above the valve seat seal is a larger angle than the included angle between the lower conical surfaces below the valve seat seal. The ensuing wear with use will cause the effective seat seal to migrate downwardly. The downward migration of the effective valve seat seal results in a smaller seat diameter which in turn increases the valve surface exposed to pressure above the valve seat seal and decreases the pressure required to open the valve which is undesirable. Accordingly, an annular groove is formed on the conical surface below the valve seat seal which limits the downward migration of the valve seat seal and the area exposed to the incoming fuel injection pump pressure as well as the minimum opening and closing pressure.

Referring to the drawings, the preferred embodiments of this invention are illustrated.

Figure 1:
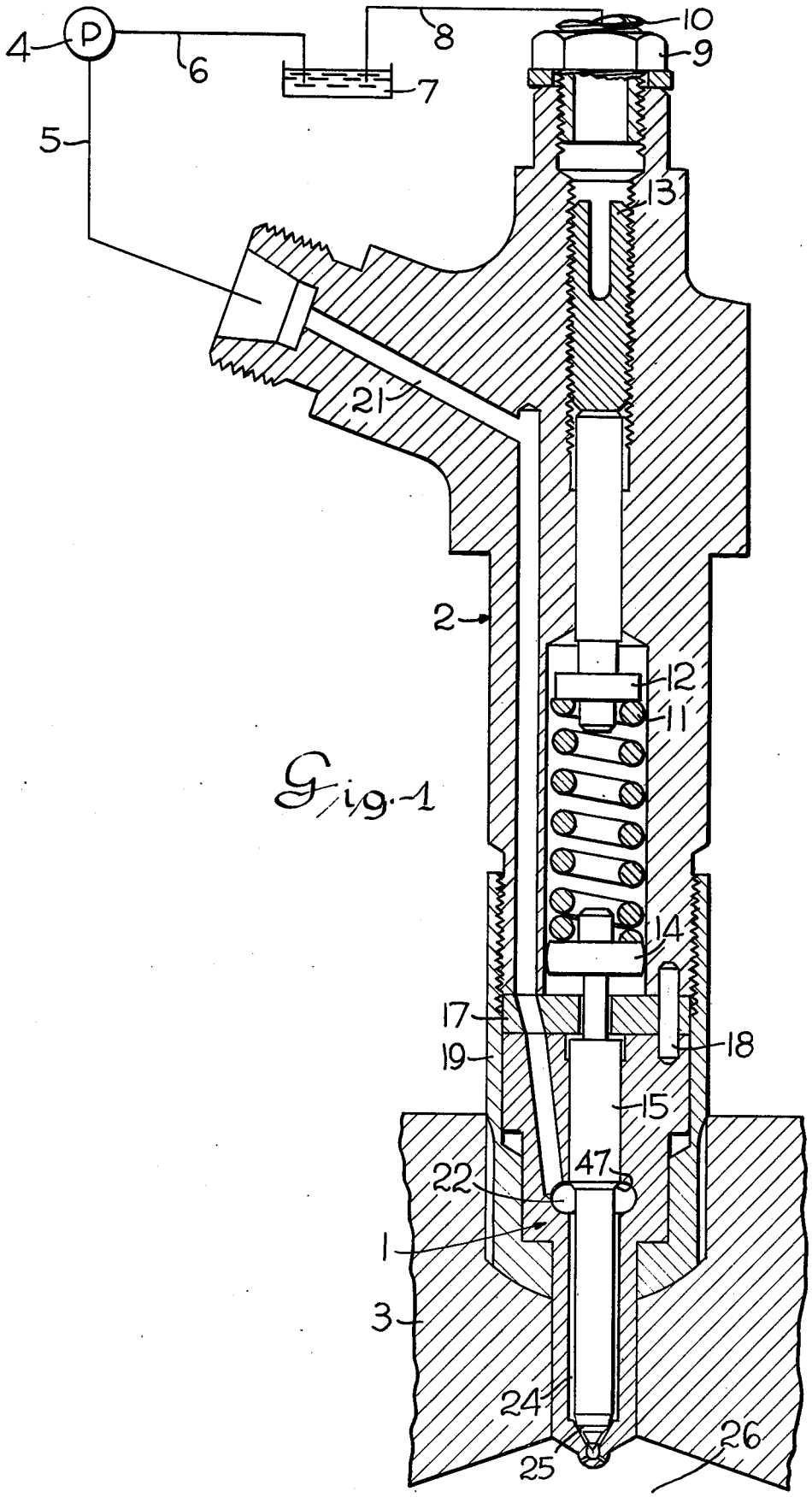
FIG. 1 illustrates a fuel injection nozzle and holder assembly.

Referring to the drawings, the fuel injection nozzle body 1 is mounted in the nozzle 2 which is supported on the engine 3. The fuel injection nozzle is connected to a pump 4 through the conduit 5. The fuel injection pump 4 is connected through conduit 6 to the fuel reservoir 7. A return line 8 is connected for drainage from the nozzle holder 2. The drain line 8 is connected through the conduit 10 in the nozzle holder 2. The spring 11 normally biases the differential valve to the closed positioned. This spring 11 is supported in the spring seat 12 and is adjusted by the adjusting screw 13 when the conduit 10 and nut 9 is removed from the nozzle holder. The lower spring seat 14 biases the valve 15 to the closed position in the nozzle body 1. The nozzle holder 2 is connected to the nozzle body 1 through the spacer 17 and dowel 18 and the cap 19. The cap 19 fastens the nozzle body 1 to the nozzle holder 2. The fuel injection pump 4 pressurizes fluid flowing into the passage 21 which is in communication with the annular chamber 22 in the nozzle body 1. Pressurized fluid is transmitted from the annular chamber 22 to the chamber 24 and the area of the differential valve above the valve seat seal 25. When a predetermined pressure is present in the annular chamber 22, the differential valve opens and fuel is injected into the combustion chamber 26 of the engine.

Figure 2:
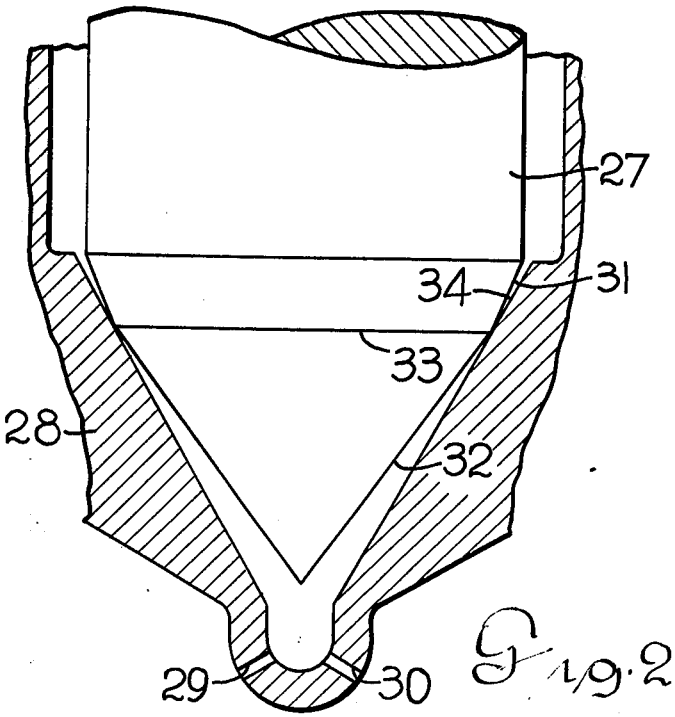
FIG. 2 illustrates a prior art double conical valve in a fuel injection nozzle.
Figure 3:
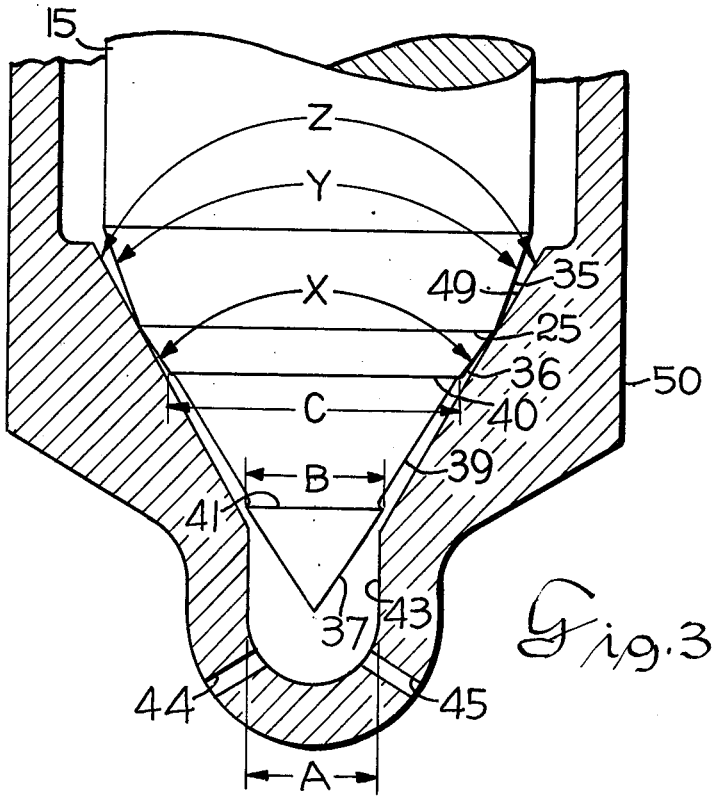
FIG. 3 illustrates the preferred embodiment of this invention showing a differential valve for a fuel injection nozzle.

FIG. 2 illustrates a prior art valve 27 normally biased to a closed position with the valve body 28 by a valve closing spring. The orifices 29 and 30 inject fuel into the combustion chamber of the engine. The valve 27 includes double conical surfaces 31 and 32 forming a valve seat seal 33. The included angle between the upper conical surface 31 of the valve 27 and the conical surface 34 of the valve body 28 is shown to be smaller above the valve seat seal 33 than the included angle between the lower conical surface 32 and the conical surface 34 of the valve body 28. The reverse relationship of angles is shown in FIG. 3. The effective valve seat seal will migrate in the direction of the smallest included angle between the valve 27 and valve body 28.

FIG. 3 illustrates an enlarged view of the differential valve of a fuel injection nozzle illustrating the preferred embodiment of the applicant's invention. The valve 15 is formed with an upper conical surface 35 joining a lower conical surface 36 to form the initial valve seat seal 25 formed by the connecting line of the two surfaces 35, 36. The segment of conical surface 36 is of the same cone angle as the segment of conical surface 37 with the groove 39 interrupting the continuation of this conical surface. The groove 39 forms a limiting edge 40 which limits the migration of the effective valve seat seal due to wear of the differential valve. The groove 39 extends to the edge 41 of conical surface 37.

The diameter "B" of edge 41 is larger than diameter "A" of the sac passage 43. This retains throttling in the lower portion of the differential valve.

The included angle between the angles "Z" and "Y" is a larger angle than the included angle between angles "X" and "Z." Accordingly, the effective seat seal will tend to migrate toward the edge 40. The diameter "C" is the minimum diameter of the effective seat seal of the differential valve.

The operation of the differential valve will be described in the following paragraphs.

During the phase of fuel injection pressurized fluid from the pump 4 enters the passage 21 and the fluid chambers 22 and 24. When a predetermined pressure in the chambers is reached the force of the pressurized fluid biases the valve 15 to an open position. The pressurized fluid acts on the shoulder 47 and the cone surface 35 which extends from the line 25 formed by the joining of the surfaces 35 and 36. The effective seat seal can migrate to the edge 40 of the conical surface 36 which increases the area exposed to the pressures of the fuel injection pump. The degree of migration is controlled by the width of the groove 39 which is formed between the cone surfaces 36 and 37. The groove 39 is of a predetermined width to form a throttling edge 41 and a surface 37 to provide a preferred operation of the differential valve.

The included angle between the angles "Z" formed by the cone surface 49 of the valve body 24 and conical surface 35 of valve 15 upstream from the valve seat seal 25 is preferably larger than the included angle between the valve body angle "Z" of the conical surface 49 and the angle "X" formed by the lower conical surfaces 36 and 37. Accordingly, with wear the effective valve seat seal will migrate toward the edge 40 of the conical surface 36. The diameter "C" of the edge 40 is determined by the width of the groove 39 and controls the effective area exposed to the pressure from the fuel injection pump and the minimum opening pressure for the differential valve.

The migration of the effective valve seat seal is due to wear and the spring force may decrease slightly as the spring is extended due to wear. The spring force, however, can be adjusted to suit the operating conditions. By limiting migration of the effective seat seal the opening pressure loss of the fuel injection nozzle can be controlled. If the opening pressure is sufficiently high, it will tend to maintain the sac chamber 43 free of hot combustion gases. This in turn will prevent hot combustion gases from producing carbon from the fuel depositing on the cone surfaces of the valve and valve body and prevent erosion in the valve to avoid failure of the fuel injection valve.

The embodiments of the invention in which an exclusive property or privilege is claimed are defined as follows:

1. A differential valve assembly in the fuel injection nozzle assembly for an internal combustion engine comprising, valve elements including a valve body and a valve defining said differential valve assembly, resilient means normally biasing said valve to a closed position with said valve body and opening in response to the force of pressurized fluid in said valve assembly opposing the biasing force of said resilient means, a nozzle defining orifices downstream from said valve, one of said valve elements including intersecting conical surfaces defining an adjoining line forming a valve seat seal when engaging the other of said elements when said valve is closed, said valve body and said valve defining a differential angle valve of a larger included angle between the conical surface of the valve body and the conical surface of the valve above said valve seat seal than the included angle between said valve body and said valve defined by the conical surface of said valve body and the conical surface of said valve downstream from said valve seat seal, the smaller included angle between said valve body and said valve downstream from said valve seat seal thereby causing the valve seat seal to migrate downstream from the initial valve seat seal due to wear of said valve body and said valve, means defining an annular groove on a conical surface downstream from the valve seat seal defining an upper edge for limiting the downward migration of said valve seat seal due to wear of said valve, and a lower edge as large as the nozzle passage downstream from said differential valve to retain throttling.

2. A differential valve assembly in a fuel injection nozzle assembly for an internal combustion engine set forth in claim 1 including, means defining a sac passage downstream from said valve for injection of fuel, said means defining said groove forms a lower edge with the lower conical surface of a larger diameter than said sac passage.

3. A differential valve in a fuel injection nozzle assembly for an internal combustion engine as set forth in claim 1 wherein said valve defines said adjoining line and seat seal of the valve assembly.

4. A differential valve in a fuel injection nozzle assembly for an internal combustion engine as set forth in claim 1 wherein said valve body defines said adjoining line and seat seal in said nozzle assembly.

5. A differential valve in a fuel injection nozzle assembly for an internal combustion engine as set forth in claim 1 including said means defining said groove in said conical surface and means defining a throttling edge downstream from said valve seat seal to throttle fuel passing through said differential valve assembly.

6. A differential valve in a fuel injection nozzle assembly for an internal combustion engine as set forth in claim 1 wherein said adjoining line between the conical surfaces upstream from the valve seat seal and the conical surface downstream from the valve seat seal forms the initial seat seal, said groove defining an edge downstream from said seat seal limits the diameter of the valve seat seal due to wear of the valve.

7. A differential valve in a fuel injection nozzle assembly for an internal combustion engine as set forth in claim 1 wherein the tip of the conical surface downstream from the valve seat seal defines a throttling surface for said differential valve.

8. A differential valve in a fuel injection nozzle assembly for an internal combustion engine as set forth in claim 1 wherein said means defining said groove defines an upper edge which is a lesser distance than one-quarter the diameter of the valve seat seal from said seat seal.

9. A differential valve in a fuel injection nozzle assembly for an internal combustion engine as set forth in claim 1 wherein means defining said groove defines a surface parallel with the conical surface interrupted by said groove.

10. A differential valve in a fuel injection nozzle assembly for an internal combustion engine as set forth in claim 1 wherein said means defining said groove forms an interruption in the lower conical surface, the lower segment of said lower conical surface retains a throttling surface for the differential valve downstream from said seat seal.

* * * * *